US007676887B2

(12) United States Patent
Chung

(10) Patent No.: US 7,676,887 B2
(45) Date of Patent: Mar. 16, 2010

(54) TWO-STAGE ADJUSTABLE DOOR HINGE

(76) Inventor: Stanley Chung, 5430 Shannon Ridge La., San Diego, CA (US) 92130

( * ) Notice: Subject to any disclaimer, the term of this patent is extended or adjusted under 35 U.S.C. 154(b) by 497 days.

(21) Appl. No.: 11/317,456

(22) Filed: Dec. 22, 2005

(65) Prior Publication Data

US 2007/0143959 A1 Jun. 28, 2007

(51) Int. Cl.
*E05D 7/04* (2006.01)

(52) U.S. Cl. ..... 16/236; 16/238; 16/240; 16/248

(58) Field of Classification Search ..... 16/236, 16/238, 240, 244, 246, 248
See application file for complete search history.

(56) References Cited

U.S. PATENT DOCUMENTS 2,725,589 A * 12/1955 Papesh ..... 16/236
5,339,493 A * 8/1994 MacIntyre ..... 16/238
5,694,665 A * 12/1997 Strickland et al. ..... 16/238
5,701,636 A * 12/1997 Jahnke ..... 16/238
5,713,105 A * 2/1998 Toomey ..... 16/245
5,799,370 A * 9/1998 Davidian et al. ..... 16/236
6,434,791 B1 * 8/2002 Chung ..... 16/387
6,484,363 B1 * 11/2002 Chung ..... 16/242
7,162,774 B1 * 1/2007 Von Resch et al. ..... 16/236
2004/0128794 A1 * 7/2004 Chung ..... 16/236

FOREIGN PATENT DOCUMENTS

JP 01238857 A * 9/1989

* cited by examiner

*Primary Examiner*—Victor Batson
*Assistant Examiner*—Roberta Delisle
(74) *Attorney, Agent, or Firm*—Patent Law Group LLP; David C. Hsia

(57) ABSTRACT

A door hinge adapted to provide vertical and depth adjustments of an engaged door with a door frame. The hinge features a first hinge member adapted for fixed recessed engagement to a side edge of a door jam which is rotationally engaged with a support member extending from a second hinge member adapted for engagement to the door. Adjustment of height and depth of the door inside the door jam is easily achieved by rotation of adjustment screws accessible from a single surface that is visible when the second hinge member is engaged to the door.

11 Claims, 2 Drawing Sheets

TWO-STAGE ADJUSTABLE DOOR HINGE

FIELD OF THE INVENTION

The invention herein disclosed and described relates to a door hinge. More particularly it relates to a door hinge, engageable between a door and the frame within which it is mounted, that provides vertical adjustment for height centering of the door relative to its position in a frame or door jam, and horizontal adjustment to adjust the depth of the door in the door jam when the door is closed.

BACKGROUND OF THE INVENTION

Conventional hinges have been used on doors, gates and cabinets for many years. In the United States and many foreign countries such hinges consist of jam-mounted hinges having two rotatably engaged hinge members which engage the door jam and the edge of the door. With this style of a hinge there are generally no adjustments, and the mounting screws and both hinge members are flush mounted in their respective surfaces and are substantially concealed between the door and the door jam when the door is closed.

Hinges are generally comprised of first and second hinge members interconnected by the means of a hinge pin for a relative pivotal movement. Once engaged and properly adjusted, the hinges maintain the door in a registered position relative to the frame in which it mounts. The first hinge member mounts to the door with hinge mounting hardware, normally wood screws for wood doors and sheet metal screws on metal doors. The second hinge member mounts to the door jam with the same hinge mounting hardware as the first hinge member.

When doors are mounted properly the door and door jam form a tight seal around the perimeter of the outside face of the door. However, when doors are not located properly or there is any shrinkage in the material or settling of the structure, there may exist too much space between the side edges of the door and the jam at the top, bottom or the sides. Conversely, improper positioning of the door may also occur when too little space between the perimeter of the door and the interior of the doorjamb is provided. This can cause improper closure and even damage to the door or door jam from the force of the door on the door jam during closure. There are other occasions when the door in the closed position is not set deep enough within the frame to form a proper seal against the jam or a seal surrounding the door jam. The resulting spaces between the door and seal often account for a draft of air entering the room and a great deal of either heat or cooling losses.

Additionally, when mounting a door it is difficult to locate the second hinge exactly in alignment with the first hinge on a two-hinge door and even more difficult to align the two additional hinges exactly on a three-hinge door. It is therefore of the utmost convenience to the user if a face-mounted hinge provides for multiple levels of adjustment and thereby allows doors to be attached and aligned for the optimum seal fit to the door jams. Such means for adjustment should maximize the amount of adjustment distance provided, as well as the increments of adjustment available to the user. This is especially helpful in the initial mounting of the door, and over a long period, to provide a means for readjustment of the door if it moves out of alignment with the jam. Further, the engagement points to initiate such adjustments should be accessible to the user without the need to dismount either hinge member.

Prior art in the area of hinges, especially for those employed in the United States, generally fails to teach or suggest easily accessible adjustment components that provide vertical adjustment of the door and a horizontal adjustment of the door for its depth when in the closed position engaged in a sealed position inside the door jam. This is generally because doors in the United States use a hinge system that requires the hinge to be recessed into the side of the door and the door jam which severely limits space for the components. Nor does prior art teach or suggest housing the adjustment components in a door mounted housing that provides easy engagement through the face place of the recess mounted housing.

With respect to the above description, before explaining at least one preferred embodiment of the invention in detail, it is to be understood that the invention is not limited in its application to the details of construction and to the arrangement of the components or steps set forth in the following description or illustrated in the drawings. The various apparatus and methods of the invention are capable of other embodiments and of being practiced and carried out in various ways which will be obvious to those skilled in the art once they review this disclosure. Also, it is to be understood that the phraseology and terminology employed herein are for the purpose of description and should not be regarded as limiting.

As such, those skilled in the art will appreciate that the concept upon which this disclosure is based may readily be utilized as a basis for designing of other devices, methods and systems for carrying out the several purposes of the present disclosed device. It is important, therefore, that the objects and claims be regarded as including such equivalent construction and methodology insofar as they do not depart from the spirit and scope of the present invention.

Further objectives of this invention will be brought out in the following part of the specification, wherein detailed description is for the purpose of fully disclosing the invention without placing limitations thereon.

SUMMARY OF THE INVENTION

The device herein disclosed and described relates to an adjustable door hinge that employs a first hinge member that is fixed to a frame. A second hinge member is formed by a housing adapted for recessed mounting in the side of a door to be rotatably engaged in the frame. Means for rotatable engagement between the first hinge member and second hinge member is provided by a hinge pin which engages a pair of sleeves extending from the first hinge member, to a second sleeve engaged to one end of a support member. The opposite end of the support member is translatably engaged within the housing forming the second hinge member.

The support member is translatably engaged within the housing such that it translates along two perpendicular planes thereby providing a means for vertical adjustment of the door relative to the door jam, and a means for depth adjustment of the door within the jam when closed. Both adjustments are independent of the other and maintain the plane of the door with the plane of the door jam during all positions of adjustment.

Adjustment for both height and depth of the door in the frame is easily achieved from a single surface by engaging a tool with either of two adjustment screws accessible through apertures formed in a cover plate which engages with the exposed side of the door mounted housing forming the second hinge member. Rather than arcing in adjustment as with most prior art hinges being adjusted for depth, the disclosed device maintains the hinge pin forming the rotation axis for the engaged members a fixed distance from the side surface of the door during all points along the horizontal depth adjustment.

Vertical adjustment in a direction substantially normal to the depth adjustment is also easily achieved by rotation of an adjustment screw accessible through an aperture in the cover plate.

To allow for vertical adjustment of the support member, the aperture for the depth adjustment screw is elongated and the screw head for the depth adjustment screw is slidably engaged in the aperture. This arrangement provides both a bearing for the depth adjustment screw during rotation and a means to limit total height adjustment of the device. Total height adjustment is limited because the screw head will engage one of the other ends of the elongated aperture once a certain amount of vertical adjustment is achieved in either direction from a neutral point. The total possible adjustment vertically therefore can be limited by the total length of the elongated aperture providing access to the depth adjustment screw which protrudes therein.

The vertical adjustment screw is geared on its exterior in a fashion adapted to engage and rotate a cooperatively configured exterior to the sleeve. The vertical adjustment screw is rotatably engaged inside a cavity formed in the housing such that its geared exterior rotates the sleeve around an axis perpendicular to the axis of the vertical adjustment screw. A center passage running through the perpendicular axis of the sleeve is threaded in a manner to engage a threaded exterior on upper and lower adjustment pins extending from the sleeve. Rotation of the vertical adjustment screw in one direction will cause the upper and lower adjustment pins to move away from each other. Rotation of the vertical adjustment screw in the opposite direction causes the upper and lower adjustment pins to draw closer. Because the axis of the vertical adjustment screw and the axis of the sleeve are perpendicular to each other, the geared engagement of their exteriors acts as a means to prevent the sleeve from rotation and moving from the desired adjustment, unless and until the vertical adjustment screw is rotated. This provides a means to prevent unintended adjustment changes which can occur from vibration.

The distal end of one of the two adjustment pins is engaged with an operatively formed recess inside the interior cavity. The distal end of the other of the two adjustment pins is engaged with a slot formed in the support member which is translatably engaged within the interior cavity using means for translatable engagement as shown using posts projecting vertically inside the interior cavity shaped to slidably engage inside slots formed in the support member. Experimentation has found that four such posts engaged in four operatively sized slots in the support member yields an exceptionally strong slidable mount of the support member to the housing. The support member so engaged will translate vertically the distance of the slots, and horizontally, upon the projecting posts during depth adjustment. As such, this post and slot engagement provides a means for translatable engagement, in two perpendicular directions, of the support member, to the second hinge member. When engaged to the door, it too is translatable in both directions.

Horizontal adjustment for depth is equally easily accomplished by rotation of the horizontal adjustment screw which is rotatably engaged at a first end with the rear wall of the housing and at the exposed end with the head portion engaged in the elongated aperture formed through the cover. This engagement of both ends of the horizontal adjustment screw fixes it in position inside the housing. This two point mount of the adjustment screw which engages the support member thereby provides a means to stabilize the support member and prevent tilt or rotation of it during use. The exterior surface of the horizontal adjustment screw is threaded for operative threaded engagement with threads formed in an aperture running through the support member. The threads can be formed in the aperture itself, or as shown, by engagement of a threaded grommet within an aperture in the support member. By centering this engagement through the support member and in-between the posts which guide it, tilt or rotation as noted above is minimized.

Horizontal adjustment for depth of the door inside the door jam is easily achieved by a simple rotation of the horizontal adjustment screw. The threaded engagement of the exterior of this adjustment screw with the support member causes the support member to translate back and forth inside the interior cavity with the slots sliding on the projecting posts which hold the support member in registered yet translatable engagement within the interior cavity. Rotation or downward torque on the support member is minimized by this four-post system which experimentation has found also minimizes potential binding of the support member with the posts by minimizing the area of frictional engagement between the sliding parts.

An object of this invention is the provision of a hinge that provides for easy adjustment of the position of a door relative to a door frame while the hinge is engaged between a door and frame.

A further object of this invention is the provision of an adjustable hinge that is adjustable in two directions to provide door and frame alignment for height and depth.

An additional object of this invention is the provision of an adjustable hinge that provides access to the adjustment screws from a single surface that is accessible once the hinge has been mounted in recessed engagement with both the door and frame.

Yet another object of this invention is the provision of faster adjustment of the hinge through the employment of opposable geared adjustment screws.

A still further object of this invention is the provision of the ability to provide mechanical advantage in adjusting a heavy door by changing the gear ratios of the opposable geared adjustment screws.

Further objects of the invention will be brought out in the following part of the specification, wherein detailed description is for the purpose of fully disclosing the invention without placing limitations thereon.

DETAILED DESCRIPTION OF THE PREFERRED EMBODIMENT

Figure 1:
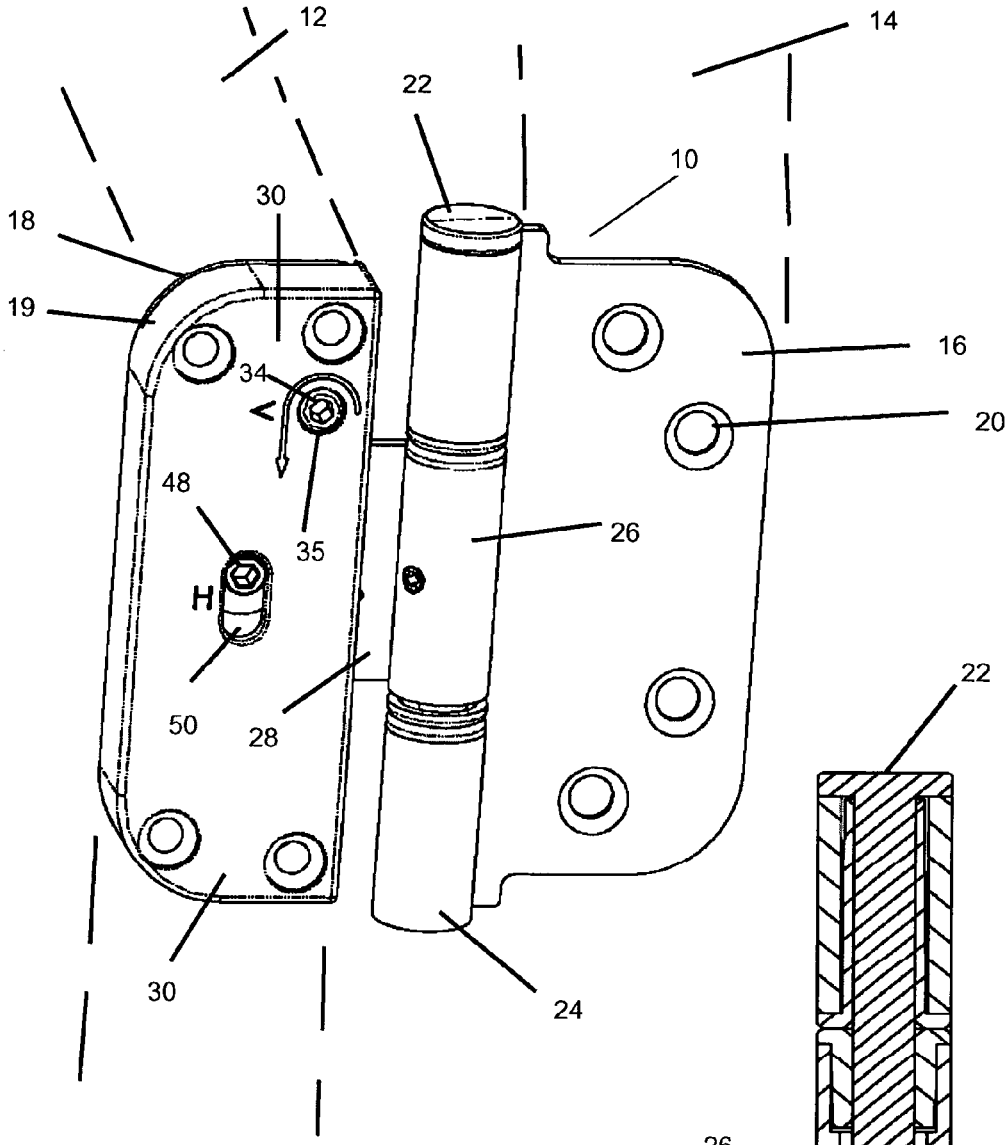
FIG. 1 depicts a perspective view of the disclosed adjustable hinge assembled with adjustment screws easily accessed even after the hinge is in a recessed mount with the door.
Figure 4:
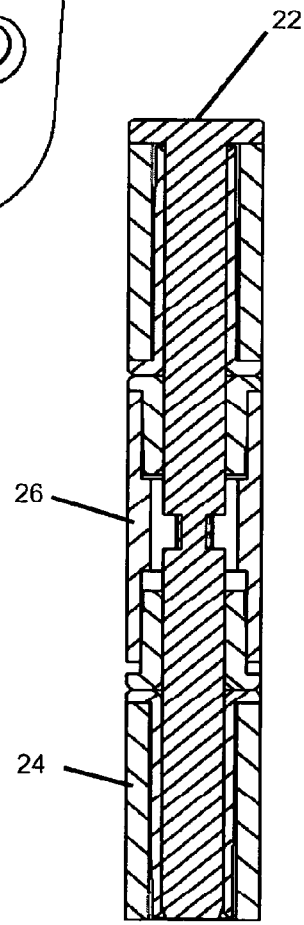
FIG. 4 is a sectional view along the axis of the hinge pin which rotationally engages the first hinge member to the distal end of the support member extending from the second hinge member.
Figure 3:
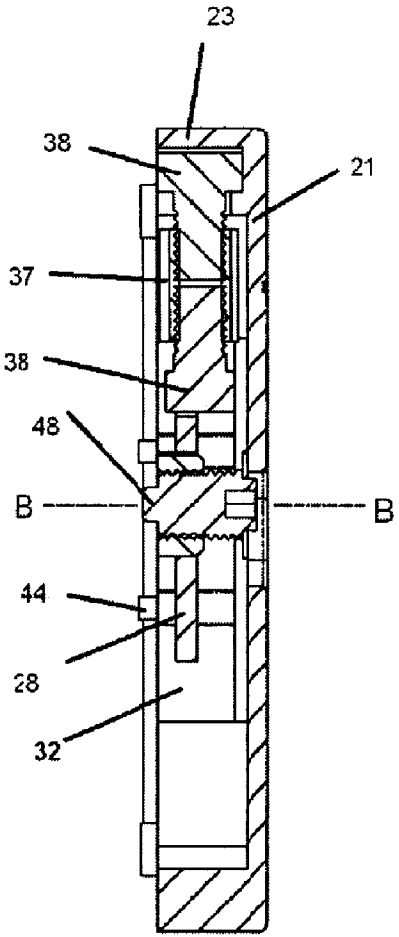
FIG. 3 is a sectional view through line A-A showing the internal components engaged in the cavity formed inside the housing.
Figure 2:
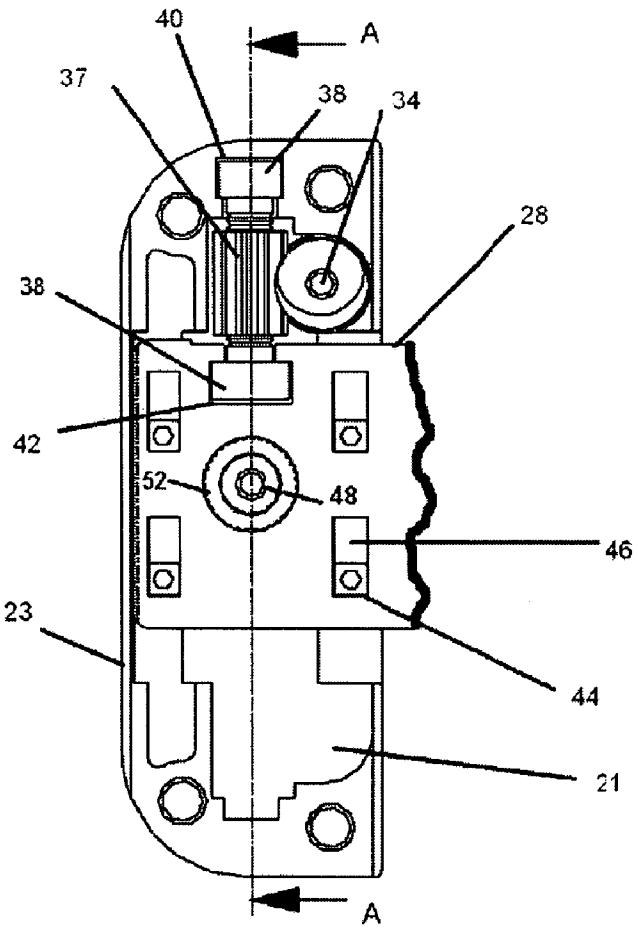
FIG. 2 is a top view of the housing forming the second hinge member with the cover plate removed showing internal components.

The device 10 as herein disclosed and depicted in FIGS. 1-4 provides a significant improvement in the function and utility of door hinges. As depicted in FIG. 1, the disclosed adjustable hinge device 10 is adapted for engagement in recesses formed in the side surface of a door 12 to provide a means for rotational engagement of the door 12 for rotation into and out of a door jam 14.

The device 10 features a first hinge member 16 adapted for a flush mount upon the side surface of a door jam 14 which is rotationally engaged with a second hinge member 18 which is adapted for recessed mounting in the side surface of the door 12. The first hinge member features screw apertures 20 for affixing it to the door jam 14. The second hinge member 18 formed by a housing 19 having a rear wall 21 and a sidewall 23 also features similar screw apertures 20 for engagement with the door 12. Means for rotatable engagement between the first hinge member 16 and second hinge member 18 is provided by a hinge pin 22 which engages a pair of sleeves 24 extending from the first hinge member 16, to a second sleeve 26 engaged operatively positioned at the distal end of a support member 28.

The opposite end of the support member 28 is translatably engaged within the housing 19 forming the second hinge member 18 such that the support member 28 translates along two perpendicular axises thereby providing a means for vertical adjustment of the door 12 relative to the door jam 14, and providing a means for depth adjustment of the door 12 within the door jam 14 when the door is in a closed position surrounded by the door jam 14.

As noted above, vertical adjustment for height and horizontal adjustment for depth of the door in the frame is easily achieved from a single surface by engaging a tool adapted to the task with either of two adjustment screws accessible through the cover plate 30 which engages over the internal cavity 32 defined by the area inside the rear wall 21 and surrounded by the sidewall 23 of the housing 19 forming the second hinge member 18.

Vertical adjustment along the axis of the hinge pin 22 is achieved by rotation of a first adjustment screw 34 which is easily accessible through a first aperture 35 formed in the cover plate 30. This aperture is sized to surround the visible portion of the first adjustment screw 34 as a bearing to maintain it in line in its mount in the internal cavity 32. The first adjustment screw 34 used for the vertical door adjustment is geared on its exterior surface in a fashion adapted to engage and rotate a cooperatively configured geared exterior to and engaged sleeve 37. A center passage running along the center axis of the sleeve 37 is threaded in a manner to engage a threaded exterior on upper and lower adjustment pins 38 extending from their engagement with each end of the sleeve 37. In this fashion, rotation of the first adjustment screw 34 in one direction will cause the upper and lower adjustment pins 38 to move away from each other and rotation in the opposite direction cause the upper and lower adjustment pins 38 to draw closer.

The distal end of one of the two adjustment pins 38 is engaged with an operatively formed recess 40 inside the interior cavity 32. The distal end of the other of the two adjustment pins 38, is engaged with a slot 42 formed in the support member 28 which is translatably engaged within the interior cavity 32 using means for translatable engagement. The current preferred mode of the device 10 employs posts 44 projecting vertically from a rear wall of the housing 19 into the interior cavity 32. These posts 44 are dimensioned slidably engage inside support apertures 46 communicating through the support member 28. The support member 28 so engaged will translate vertically a distance equal to the length of the support apertures 46 and allow for concurrent horizontal translation upon the projecting posts 44 for depth adjustment of the door 12. As such, this post and slot engagement provides a means to engage the support member 28 to the second hinge member 18 and provide for concurrent translation of the support member in two perpendicular directions, when the appropriate adjustment screw is rotated. Further, because the axis of the first adjustment screw 34 and the axis of the sleeve 37 are perpendicular to each other, their geared engagement provides a means to prevent the sleeve from rotation unless the first adjustment screw is turned, thereby providing a means to prevent unintended adjustment changes which can occur from vibration or after long use of the door 12.

Horizontal adjustment for depth of the door 12 in its fit to the door jam 14 is accomplished by rotation of the second adjustment screw 48 which is rotatably engaged at a first end with the rear wall 21 of the housing 19 and an exposed end with the head portion engaged in the elongated aperture 50 formed through the cover plate 30. As noted earlier, this engagement of both ends of the second adjustment screw 48 fixes it in position inside the housing 19 in a solid two point mount. When engaged through the support member 28, this preferred arrangement thereby provides a means to stabilize the support member 28 and prevent tilt or angling during use with the heavy load of the door 12 engaged.

The exterior surface of the second adjustment screw 48 is threaded for operative threaded engagement with cooperating threads formed in an aperture running through the support member 28. The threads can be formed in the aperture itself, or as shown, by engagement of a threaded grommet 52 within an aperture in the support member 28. By centering this engagement through the support member 28 and in-between the posts 44, tilt or rotation of the support member 28, as noted above, is prevented or minimized.

To achieve a horizontal adjustment of the depth of the door 12 inside the door jam 14 the user would employ a tool adapted to engage the second adjustment screw 48 and rotate it. The threaded engagement of the second adjustment screw with the support member 28 causes the support member 28 to translate back and forth inside the interior cavity 32 toward and away from the rear wall 21 with the support apertures 46 riding on the exterior of the projecting posts 44 to thereby hold the support member 28 in registered yet translatable engagement with the second hinge member 18. As noted above, rotation or downward torque of the door which might twist the support member 28 is minimized by this currently preferred four post system.

Finally, it should be noted that in the case of heavy doors, both faster and slower adjustment along both axises can be provided by changing the gear ratios of the opposable geared engagements. Further, mechanical advantage can also be obtained with such ratios which is especially useful when the device 10 is employed to rotationally mount very heavy doors.

Although the invention has been described with respect to particular embodiments thereof, it should be realized that various changes and modifications may be made therein without departing from the spirit and scope of the invention. While the invention as shown in the drawings and described in detail herein discloses arrangements of elements of particular construction and configuration for illustrating preferred embodiments of structure and method of operation of the present invention, it is to be understood, however, that elements of different construction and configuration and other arrangements thereof, other than those illustrated and described, may be employed in accordance with the spirit of this invention. Any and all such changes, alternations and modifications as would occur to those skilled in the art are considered to be within the scope of this invention as broadly defined in the appended claims.

Further, the purpose of the attached abstract is to enable the U.S. Patent and Trademark Office and the public generally, and especially the scientists, engineers and practitioners in the art who are not familiar with patent or legal terms or phraseology to determine quickly from a cursory inspection the nature and essence of the technical disclosure of the application. The abstract is neither intended to define the invention of the application which is measured by the claims, nor is it intended to be limiting as to the scope of the invention in any way.

What is claimed is:

1. An adjustable door hinge comprising:

a first hinge member, said first hinge member adapted for engagement to a door jam;

an elongated second hinge member, said second hinge member having a rearwall, said rearwall having a perimeter edge;

said second hinge member having a sidewall extending substantially perpendicular to said rear wall along said perimeter edge;

said second hinge member having an internal cavity defined by the area between said rearwall and said sidewall;

a cover plate adapted for engagement to said second hinge member;

said second hinge member adapted for, recessed engagement to the sidewall of a door;

a support member, said support member having a first end and having a second end;

means for rotatable engagement of said first hinge member to said first end of said support member;

means for translatable engagement in two substantially perpendicular directions, of said second end of said support member, within said cavity;

said second end of said support member translatable along a first axis running substantially parallel to said rear wall;

said second end of said support member translatable along a second axis, toward and away from said rearwall, along an axis 1 substantially normal to said first axis;

first means of adjustment of said second end to translate said second end of said support member to adjustably fixed positions along said first axis, between a starting position and an end position;

said first means of adjustment comprising:

a first adjustment pin having a first end in fixed engagement with said support member;

a second adjustment pin having a first end in fixed engagement with said second hinge member;

wherein the said first and second adjustment pins are axially aligned along the same axis;

a sleeve, said sleeve having a geared exterior wall and having a threaded axial passage running therethrough;

an adjustment screw rotationally mounted in said internal cavity having a center axis perpendicular to said axial passage and having a head portion adapted for tooled engagement through an aperture in said cover plate;

said adjustment screw having a geared exterior in an engagement with said geared exterior wall of said sleeve; and said respective second ends of said first adjustment pin and said second adjustment pin, in a threaded engagement with said axial passage such that a rotation of said adjustment screw causes said first and second adjustment pins to move toward or away from each other to translate said support member along said first axis;

second means of adjustment of said second end to translate said second end of said support member to adjustably fixed points along said second axis, between a starting point and an end point; and both said first means of adjustment and said second means of adjustment adapted for tooled engagement on respective engagement ends, said respective engagement ends both accessible through respective first and second apertures in said cover plate, whereby said door may be adjusted for fit within said jam along two axises with both said first and second means of adjustment, visible to said user when viewing said coverplate.

2. The adjustable door hinge of claim 1 wherein said means for translatable engagement in two substantially perpendicular directions, of said second end of said support member comprises:

four posts engaged at a first end to said rear wall and extending parallel to said second axis to distal ends terminating in said internal cavity;

four slots communicating through said support member in positions to engage said four posts, said slots being elongated and running along said first axis.

3. The adjustable door hinge of claim 1 additionally comprising:

said first aperture communicating through said cover plate being elongated and having sidewalls running a length between a first end to a second end;

said engagement end of said first means of adjustment adapted for slidable engagement within said first aperture between said sidewalls; and said first end determining said starting position along said first axis and said second end of said first aperture determining said end position along said first axis.

4. The adjustable door hinge of claim 2 additionally comprising:

said first aperture communicating through said cover plate being elongated and having sidewalls running a length between a first end to a second end;

said engagement end of said first means of adjustment adapted for slidable engagement within said first aperture between said sidewalls; and said first end determining said starting position along said first axis and said second end of said first aperture determining said end position along said first axis.

5. The adjustable door hinge of claim 1 wherein said second means of adjustment of said second end comprises:

an adjustment screw rotationally engaged within said internal cavity with engagement end within said internal cavity;

said adjustment screw having a threaded exterior surface; and an aperture communicating through said support member having a sidewall adapted for threaded engagement with said exterior surface whereby rotation of said adjustment screw causes said support member to translate along said second axis.

6. The adjustable door hinge of claim 2 wherein said second means of adjustment of said second end comprises:

an adjustment screw rotationally engaged within said internal cavity with engagement end within said internal cavity;

said adjustment screw having a threaded exterior surface; and an aperture communicating through said support member having a sidewall adapted for threaded engagement with said exterior surface whereby rotation of said adjustment screw causes said support member to translate along said second axis.

7. The adjustable door hinge of claim 3 wherein said second means of adjustment of said second end comprises:

an adjustment screw rotationally engaged within said internal cavity with engagement end within said internal cavity;

said adjustment screw having a threaded exterior surface; and an aperture communicating through said support member having a sidewall adapted for threaded engagement with said exterior surface whereby rotation of said adjustment screw causes said support member to translate along said second axis.

8. The adjustable door hinge of claim 4 wherein said second means of adjustment of said second end comprises:

an adjustment screw rotationally engaged within said internal cavity with engagement end within said internal cavity;

said adjustment screw having a threaded exterior surface; and an aperture communicating through said support member having a sidewall adapted for threaded engagement with said exterior surface whereby rotation of said adjustment screw causes said support member to translate along said second axis.

9. The adjustable door hinge of claim 1 additionally comprising:

said geared exterior of said adjustment screw in said engagement with said seared exterior wall of said sleeve providing means to prevent rotation of said sleeve, and resulting unintended changes in said fixed positions of said support member along said first axis.

10. An adjustable door hinge, comprising:

a first hinge member;

a second hinge member, comprising:

a support member pivotally engaged along a first direction to the first hinge member, the support member defining a slot;

a housing defining a recess;

a sleeve having a threaded internal passage along the first direction and a geared exterior;

an adjustment screw aligned along a second direction perpendicular to the sleeve, the adjustment screw having a geared exterior engaged with the geared exterior of the sleeve;

an upper adjustment pin having an upper end received in the recess of the housing and a threaded lower end received in the passage of the sleeve; and a lower adjustment pin having a lower end received in the slot of the support member and a threaded upper end received in the passage of the sleeve; and wherein a rotation of the adjustment screw rotates the sleeve to move the upper and the lower adjustment pins toward or away from each other along the first direction, thereby moving the support member along the first direction.

11. The adjustable door hinge of claim 10, further comprising:

an other adjustment screw aligned along the second direction; and wherein the support member defines a threaded aperture for receiving the other adjustment screw, and a rotation of the other adjustment screw moves the support member along the second direction.

* * * * *